US010583343B2

(12) United States Patent
Pippitt et al.

(10) Patent No.: US 10,583,343 B2
(45) Date of Patent: Mar. 10, 2020

(54) BATTING TEE

(71) Applicant: Launch Angle Tee, Inc., Durham, NC (US)

(72) Inventors: Charles James Pippitt, Durham, NC (US); William Brent Wright, Raleigh, NC (US); Kenneth Collins Judge, Tallahassee, FL (US)

(73) Assignee: Launch Angle Tee, Inc., Durham, NC (US)

( * ) Notice: Subject to any disclaimer, the term of this patent is extended or adjusted under 35 U.S.C. 154(b) by 0 days.

(21) Appl. No.: 15/941,616

(22) Filed: Mar. 30, 2018

(65) Prior Publication Data

US 2019/0168093 A1 Jun. 6, 2019

Related U.S. Application Data

(60) Provisional application No. 62/593,374, filed on Dec. 1, 2017.

(51) Int. Cl.

| | |
|---|---|
| ***A63B 71/00*** | (2006.01) |
| ***A63B 69/00*** | (2006.01) |
| *A63B 71/02* | (2006.01) |

(52) U.S. Cl.

CPC .. *A63B 69/0075* (2013.01); *A63B 2069/0008* (2013.01); *A63B 2071/026* (2013.01); *A63B 2209/02* (2013.01); *A63B 2225/093* (2013.01)

(58) Field of Classification Search

CPC ..... A63B 69/0075; A63B 2069/0008; A63B 2225/093

USPC ..... 473/417, 420, 422, 451, 387, 398; D21/715–720

See application file for complete search history.

(56) References Cited

U.S. PATENT DOCUMENTS

| | | | | |
|---|---|---|---|---|
| 2,659,604 A | | 11/1953 | Mcgowen | |
| D210,837 S | | 4/1968 | Warner | |
| 4,364,563 A | * | 12/1982 | Stafford | A63B 69/0075 473/417 |
| 4,854,587 A | * | 8/1989 | Groves | A63B 69/0075 473/417 |
| D373,806 S | | 9/1996 | Bunnell | |
| 5,662,241 A | | 9/1997 | Sorensen | |
| 6,234,916 B1 | | 5/2001 | Carusillo et al. | |

(Continued)

FOREIGN PATENT DOCUMENTS

| | | |
|---|---|---|
| DE | 29914319 U1 | 12/1999 |
| WO | 2004022167 A2 | 3/2004 |

*Primary Examiner* — Mitra Aryanpour

(74) *Attorney, Agent, or Firm* — United IP Counselors, LLC

(57) ABSTRACT

A kit for a batting tee includes a ball holder including a first prong and a second prong, the first prong at a first distal end of the ball holder and including a first recess, the second prong at the first distal end of the ball holder and including a second recess. The ball holder further includes a holder connector disposed at a second distal end of the ball holder, the second distal end of the ball holder opposing the first distal end of the ball holder, the first prong and the second prong extending from the holder connector in a planar fashion with each other. The kit includes a shaft including a first distal end to be attached to the holder connector, and a base including a top surface, the top surface including a mount to which a second distal end of the shaft is to be mounted.

8 Claims, 19 Drawing Sheets

(56) References Cited

U.S. PATENT DOCUMENTS

| | | | | |
|---|---|---|---|---|
| 6,290,617 | B1 | 9/2001 | Cole et al. | |
| D451,566 | S | 12/2001 | De Chenne | |
| D486,538 | S * | 2/2004 | Cardarelli | D21/717 |
| D488,525 | S * | 4/2004 | Cardarelli | D21/717 |
| 7,204,769 | B2 * | 4/2007 | Bandimere | A63B 69/0075 473/417 |
| D566,801 | S | 4/2008 | Grant | |
| D586,411 | S * | 2/2009 | Iacono | D21/717 |
| D620,542 | S | 7/2010 | Sheffield | |
| D633,583 | S | 3/2011 | Guevara | |
| D638,079 | S | 5/2011 | Cheng | |
| 8,109,844 | B1 * | 2/2012 | Quinn | A63B 69/0075 473/417 |
| 8,393,980 | B2 * | 3/2013 | Chen | A63B 69/0002 473/417 |
| 8,672,780 | B2 * | 3/2014 | Fournier | A63B 69/0075 473/417 |
| 8,858,369 | B2 * | 10/2014 | Murphy | A63B 69/0002 473/417 |
| 8,974,324 | B2 * | 3/2015 | Chen | A63B 69/0075 473/417 |
| 9,050,516 | B2 * | 6/2015 | Holland | A63B 69/0075 473/417 |
| 9,358,440 | B1 * | 6/2016 | Burrell | A63B 69/0002 473/417 |
| 9,724,582 | B2 * | 8/2017 | Burrell | A63B 69/0002 473/417 |
| 2003/0032505 | A1 | 2/2003 | Christensen | |
| 2005/0266936 | A1 | 12/2005 | Gutierrez | |
| 2007/0123370 | A1 | 5/2007 | Goucher et al. | |
| 2009/0029803 | A1 * | 1/2009 | Lincoln | A63B 69/0075 473/417 |
| 2009/0227396 | A1 | 9/2009 | Bronson | |
| 2010/0216576 | A1 | 8/2010 | Sanders | |
| 2010/0248865 | A1 | 9/2010 | Otsubo | |
| 2011/0224029 | A1 | 9/2011 | Day et al. | |

* cited by examiner

BATTING TEE

CROSS-REFERENCE TO RELATED APPLICATIONS

This application claims priority to U.S. Provisional Application No. 62/593,374, filed on Dec. 1, 2017. The contents of that application are herein incorporated by reference in their entirety.

BACKGROUND

Technical Field

The present disclosure relates generally to batting tees and attachments suitable for use in batting practice and other swing training exercises.

Background Technology

Various technologies hold a ball at an elevated position above the ground. These technologies range from a string suspending a ball from above, a pipe rising perpendicularly from the ground, or a spring rising perpendicularly from the ground, or a batting tee. A batting tee can provide a batter a stable target at a repeatable position to swing at. The ball can then be the target of a swing of a bat, stick, or club. Thus, a batting tee allows a person to strike a ball with a bat, without the ball being thrown by a pitcher or machine.

A conventional batting tee includes a flexible tube attached to a shaft that is attached to a base. The shaft is attached to the base at a perpendicular angle. The top end of the flexible tube has a round opening. The top end of the flexible tube conventionally has a conic shape. The shaft can be extended or compressed to adjust the height of the ball from the base. The base has a flat plate-like shape that rests on the ground.

BRIEF SUMMARY

In one implementation, a kit for a batting tee includes a ball holder including a first prong and a second prong, the first prong disposed at a first distal end of the ball holder and including a first recess, the second prong disposed at the first distal end of the ball holder and including a second recess, the ball holder further including a holder connector disposed at a second distal end of the ball holder, the second distal end of the ball holder opposing the first distal end of the ball holder, the first prong and the second prong extending from the holder connector in a planar fashion with each other, a shaft including a first distal end to be attached to the holder connector; and a base including a top surface, the top surface including a mount to which a second distal end of the shaft is to be mounted.

In one implementation, the base includes a bottom surface, and the mount inclines the shaft at an angle between 25 to 65 degrees with respect to the bottom surface.

In one implementation, the holder connector is an annular recess, and the first prong and the second prong extend in a planar fashion with the holder connector.

In one implementation, the first recess and the second recess are spherical cutouts of a sphere having a diameter between 72 millimeters and 97 millimeters (2.8 inches and 3.8 inches).

In one implementation, the shaft includes a first rod, a second rod, and a telescoping connector coaxially connecting the first rod and the second rod.

In one implementation, the base includes a first foot and a second foot, the first foot and the second foot protruding in a first direction with respect to the mount.

In one implementation, the base further includes a counter-balance protruding in a second direction with respect to the mount, the second direction opposite to the first direction.

In one implementation, the mount includes a threaded portion, and the second distal end of the shaft includes a threaded portion to thread into the threaded portion of the mount, the second distal end of the shaft opposing the first distal end of the shaft.

In one implementation, the mount includes a recess, and the second distal end of the shaft is friction fit into the recess.

In one implementation, the first distal end of the shaft friction fits into the holder connector.

In one implementation, the holder connector is an annular recess.

In one implementation, the first recess and the second recess face in the same direction.

In one implementation, a kit for a batting tee, includes a base including a top surface; a shaft including mounting means for mounting the shaft to the base; and a ball holder including ball holding means for holding a ball at a first distal end of the ball holder; and securing means for securing the ball holder to the shaft.

In one implementation, the base includes a bottom surface, and the base inclines the shaft at an angle between 25 to 65 degrees with respect to the bottom surface.

In one implementation, the securing means are disposed at a second distal end of the ball holder.

In one implementation a ball holder for a batting tee includes a first prong disposed at a first distal end of the ball holder and including a first recess; a second prong disposed at the first distal end of the ball holder and including a second recess, the first prong and the second prong extending in a planar fashion with each other; and a connector to connect the ball holder to the batting tee.

In one implementation, the connector is an annular recess or an elliptical recess.

In one implementation, the first recess and the second recess are spherical cutouts of a sphere having a diameter between 72 millimeters and 97 millimeters (2.8 inches and 3.8 inches).

In one implementation, the connector is disposed at a second distal end of the ball holder, the second distal end opposite to the first distal end.

In one implementation, the connector is inclined at an angle between 25 and 65 degrees with respect to a bottom surface of the ball holder.

DETAILED DESCRIPTION

Figure 1:
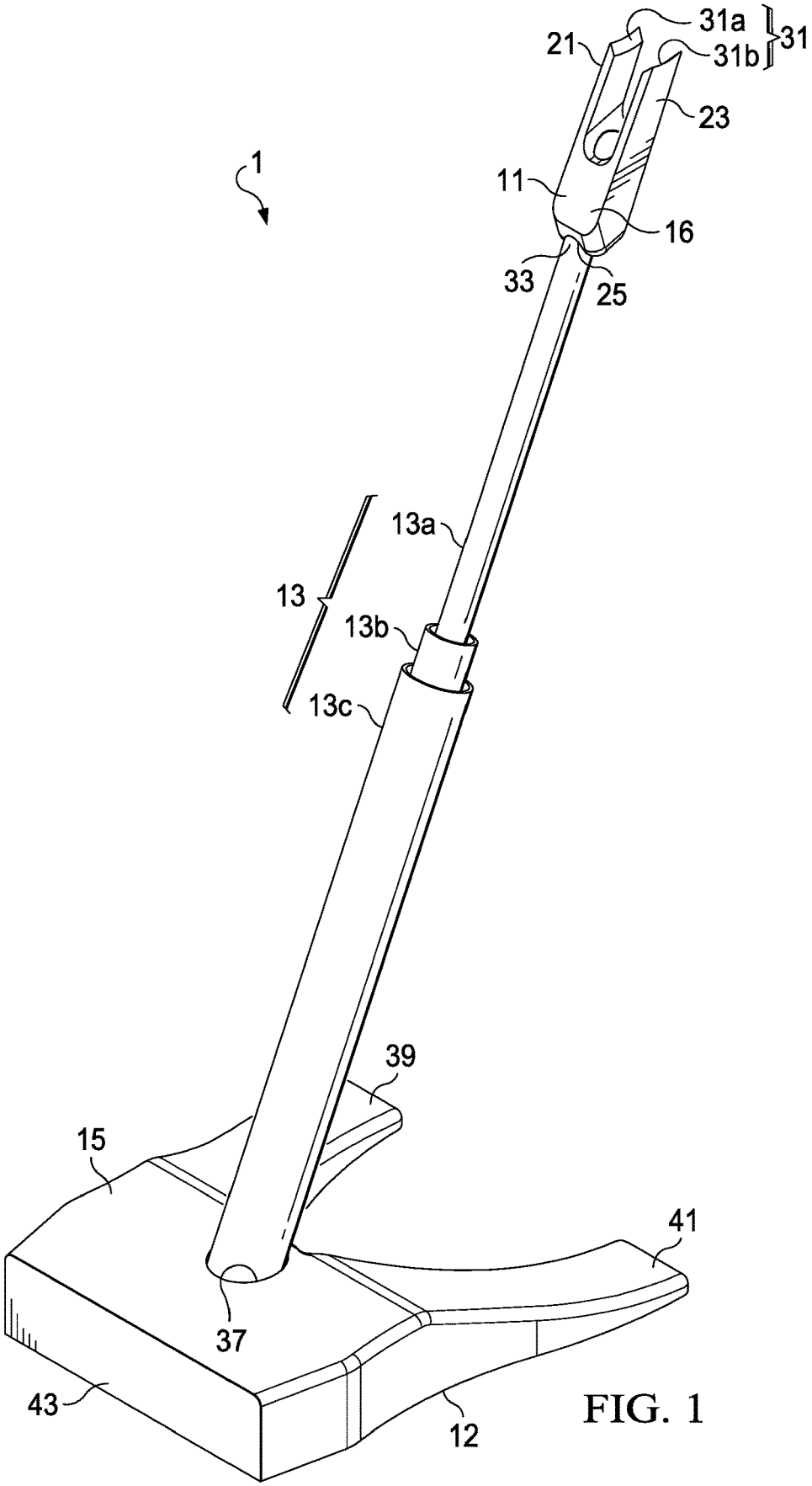
FIG. 1 is a perspective view of a batting tee.

For the purposes of this disclosure, an approach angle indicates an angle at which a bat is swung at a ball, and a launch angle indicates an angle at which a ball travels immediately after being struck by a bat. Both the approach angle and the launch angle are described with respect to a horizontal direction H. The horizontal direction H is parallel to a bottom surface of a tee that rests on the plane of a field of play or practice for games such as baseball or softball.

In games such as baseball and softball, the team that has scored the most runs will win the game. A homerun is a fair hit of a ball that allows the batter to make a complete circuit of the bases without stopping and score a run in such games. For the purposes of this description, a homerun hit is a hit in which the ball is struck by a batter that causes the ball to travel over an outfield boundary in fair territory. Most homerun hits occur when the ball is struck and travels at a launch angle of 15 to 25 degrees.

It is an object of the present disclosure to provide a batting tee that will allow a batter to better practice swings that will produce more homerun hits than a conventional batting tee. A batting tee according to the present disclosure can encourage practicing a homerun swing.

The conventional batting tee inadvertently discourages a swing that is optimized for homerun hits. The tube of the conventional tee is clearly visible next to the ball from the point of view of batters using the conventional tee. When using the conventional batting tee, the batter will swing to avoid impact with the tube of the conventional tee. This modified swing often results in the batter swinging at a suboptimal approach angle, which causes a launch angle of the ball of less than 15 degrees. For example, the batter practicing with the conventional batting tee often hits the top of the ball. This hit generates top spin on the ball and relatively short travel distances before the ball reaches the ground. Thus, the conventional tee discourages the batter to swing at an approach angle that is efficient at producing homeruns.

The conventional batting tee is likely to fail during batting practice when batters practice swinging for homeruns. Hitting the ball at a desirable approach angle necessitates striking the flexible tube of the conventional batting tee. Thus, the batters will repeatedly strike the flexible tube of the conventional batting tee when swinging at desirable approach angles that produce homeruns. The flexible tube significantly interferes with the swing of the bat, and will fail as a result of repeated impacts.

An object of the batting tee described in the present disclosure is to improve focus on the ball. Another object of the batting tee described in the present disclosure is to improve the quality of physical feedback. Another object of the batting tee described in the present disclosure is to encourage swinging at an approach angle that results in a launch angle ideal for homeruns. Another object of the batting described in the present disclosure is to provide a durable batting tee. These and further advantages of the batting tee described herein will become apparent in the following description of the batting tee.

FIGS. 1-7 depict a first embodiment of a batting tee 1 including a ball holder 11, a shaft 13, and a base 15. FIG. 1 is a perspective view of a batting tee. The ball holder 11 is attached to a first end of the shaft 13. A second end of the shaft 13 is attached to the base 15. The shaft 13 protrudes from the base 15. The ball holder 11 protrudes from the shaft 13.

Figure 2:
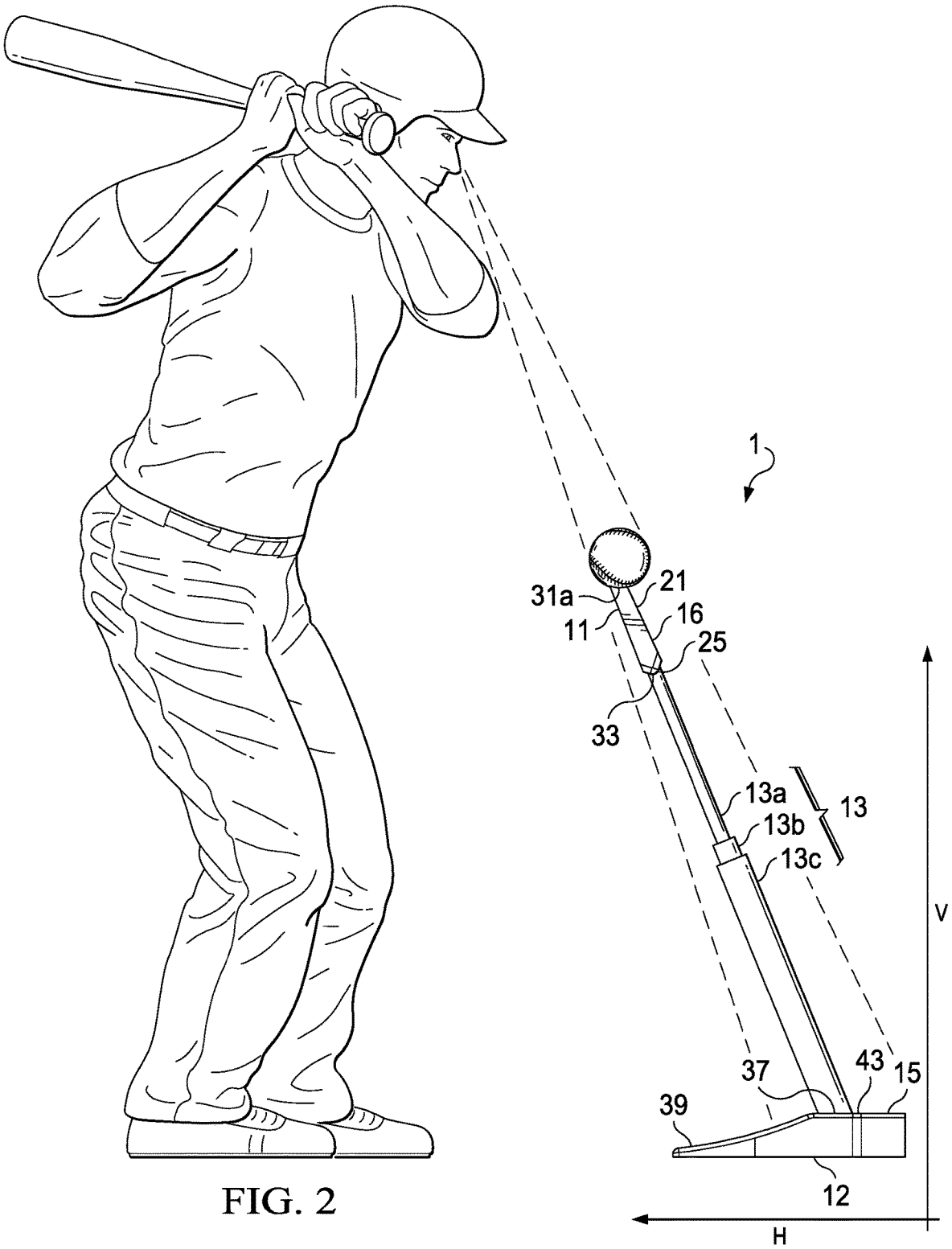
FIG. 2 is a left side elevation view illustrating a use of the batting tee.

FIG. 2 is a left side elevation view illustrating a use of the batting tee. Specifically, when a batter faces the batting tee 1 as illustrated in FIG. 2, a batter can better focus on a ball being held by the batting tee 1. In other words, the batting tee 1 can hold the ball so that the ball appears relatively larger than the tee. The batting tee 1 holds the ball such that the ball holder 11 is mostly hidden behind the ball from the perspective of the batter. As illustrated in FIG. 2, the batter will have an unobstructed view of the ball, and the portions of the batting tee 1 nearest to the ball can be hidden behind the ball. In this arrangement, the batter can feel encouraged to swing at the ball as if there are no barriers that will interfere with swinging at approach angles ideal for homeruns. In other words, the batting tee 1 can hold the ball so that the batter can focus on the ball without distraction from the batting tee 1.

Figure 3:
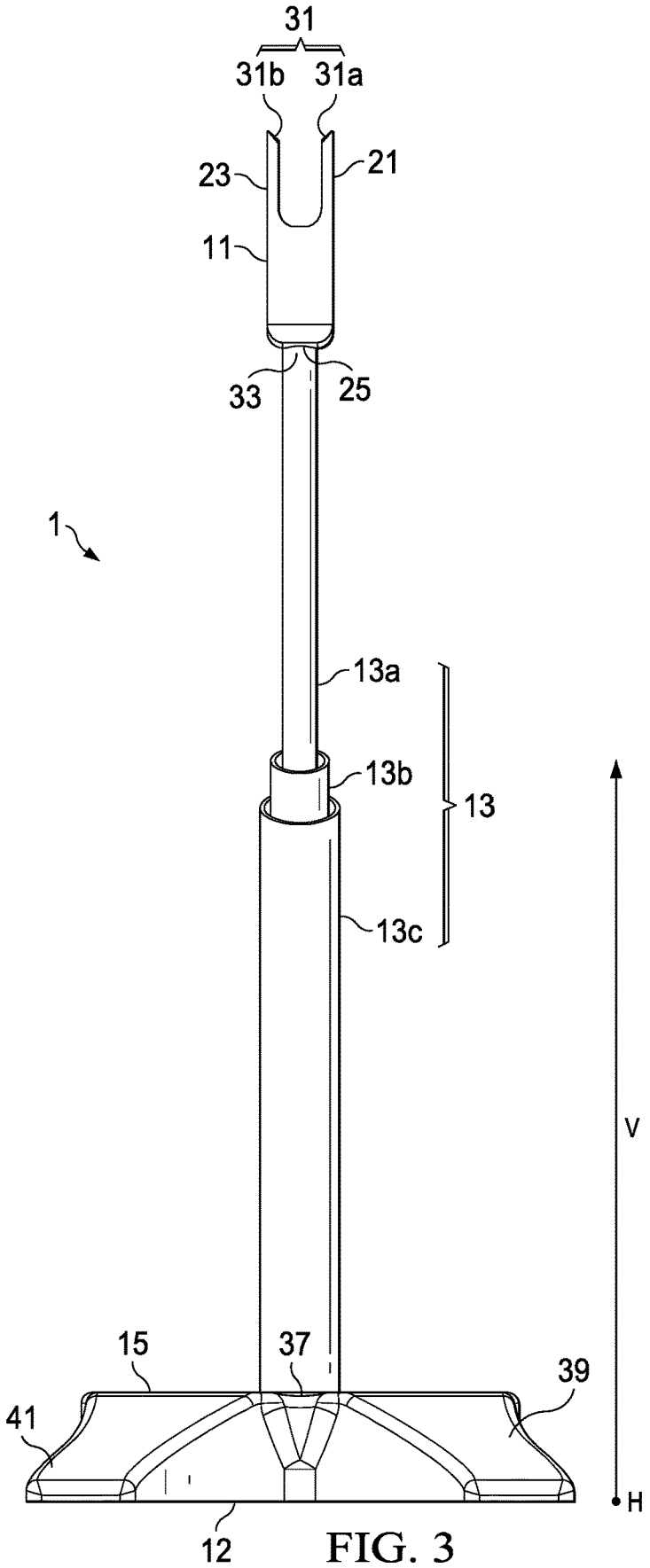
FIG. 3 is a front elevation view of the batting tee.

A batter can alternatively view the batting tee 1 arranged as illustrated in FIG. 3. FIG. 3 is a front elevation view of the batting tee. From that position, the batter can be guided to swing at the ball at an upward approach angle that is likely to result in a launch angle between 15 and 25 degrees from the horizontal direction H. The horizontal direction H is parallel to a bottom surface 12 of the batting tee. In this arrangement, to the batter, the ball can appear as if it is floating in mid-air.

Figure 4:
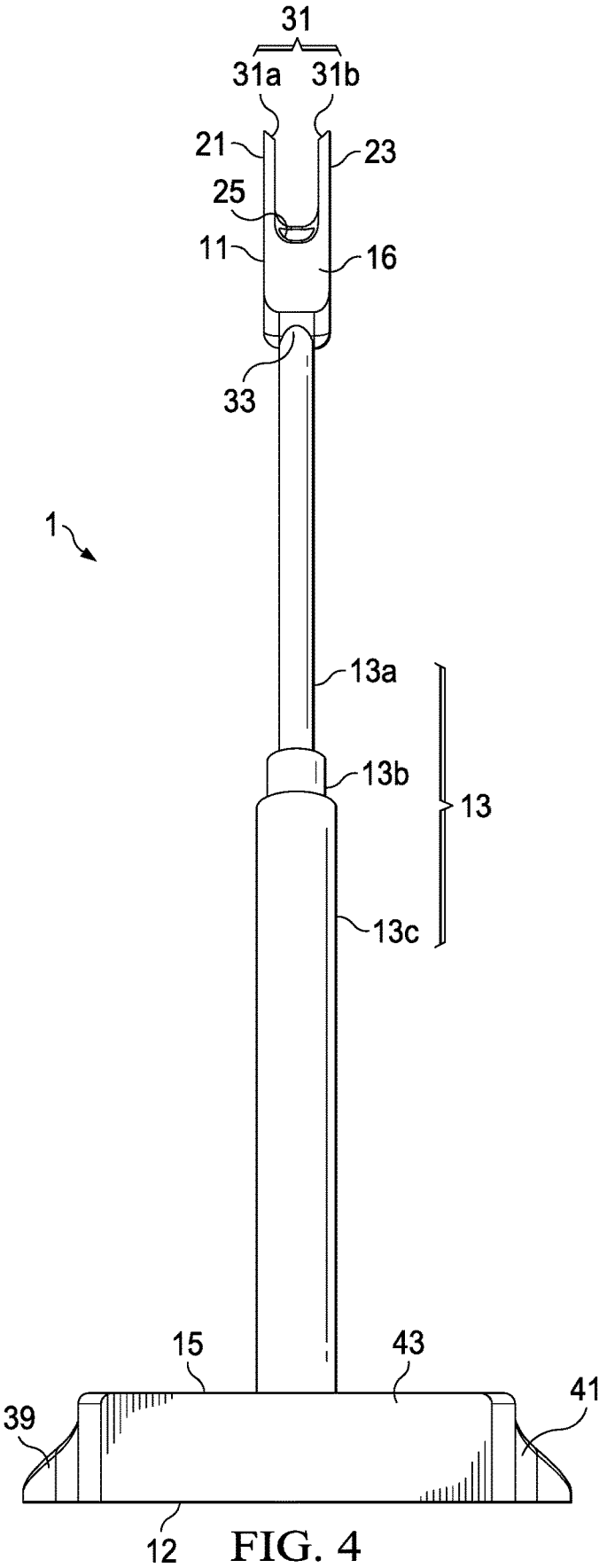
FIG. 4 is a rear elevation view of the batting tee.

FIG. 4 is a rear elevation view of the batting tee.

Figure 5:
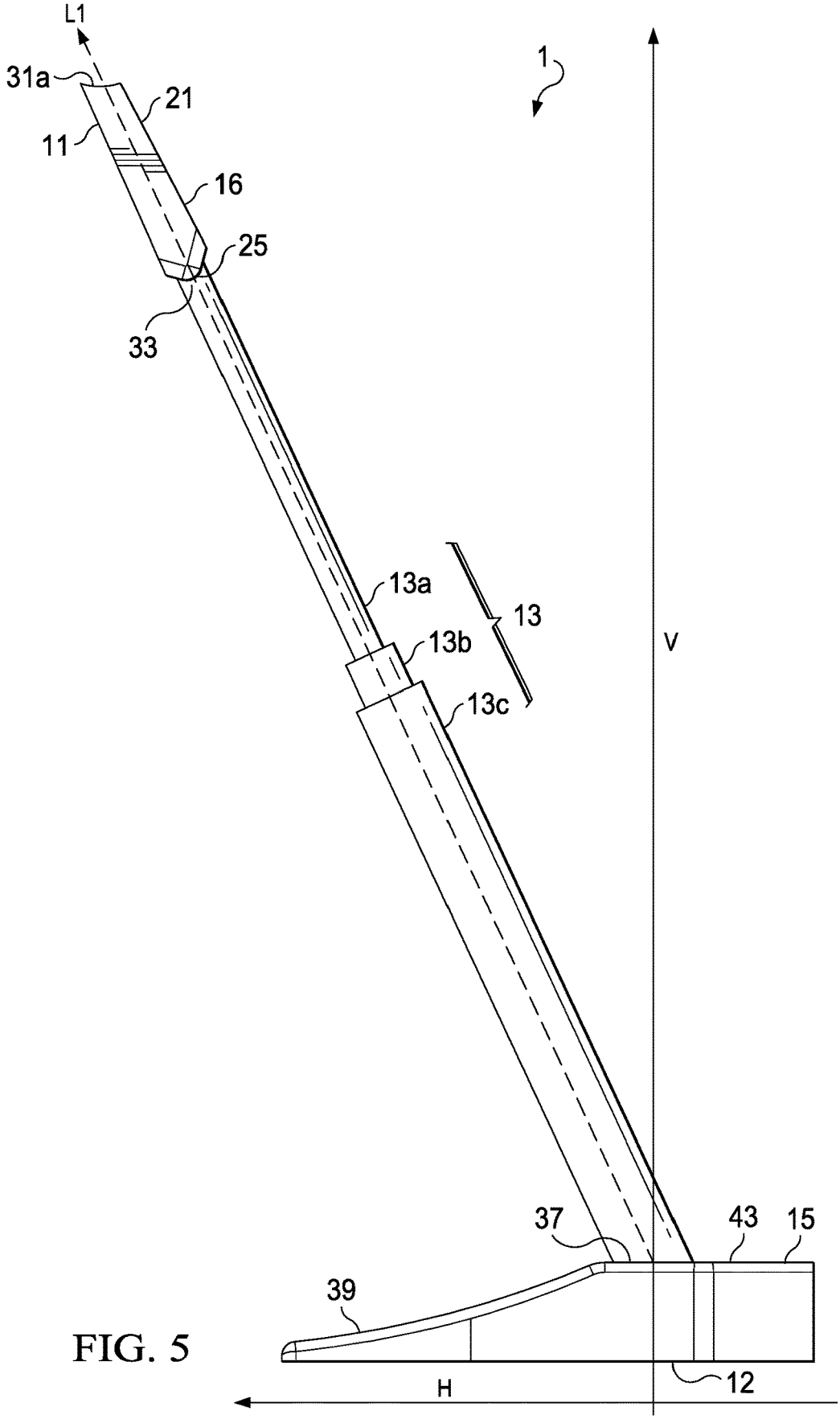
FIG. 5 is a left side elevation view of the batting tee.

FIG. 5 is a left side elevation view of the batting tee. When a right-handed batter takes a batting stance viewing the batting tee 1 arranged as illustrated in FIG. 5, the batter can be guided to swing at the ball at an upward approach angle that is likely to result in a launch angle between 15 and 25 degrees from the horizontal direction H (shown in FIG. 2). For example, for a right-handed batter, the arrangement of the batting tee 1 illustrated in FIG. 5 provides a visual guide surface 16 that is inclined from the horizontal direction H. For example, the visual guide surface 16 can be a visual cue that reminds the batter to swing at the ball at an inclined angle relative to the horizontal direction H. That is, the visual guide surface 16 can encourage a batter to swing upwards towards the ball. Alternatively, a right-handed batter can face the batting tee 1 from the opposite side of the batting tee 1 illustrated in FIG. 5. This arrangement provides a visual confirmation of the exposure of lower surfaces of the ball. As a result, the batter can see that there are no barriers that will interfere with swinging at the ball at approach angles ideal for homeruns.

Figure 6:
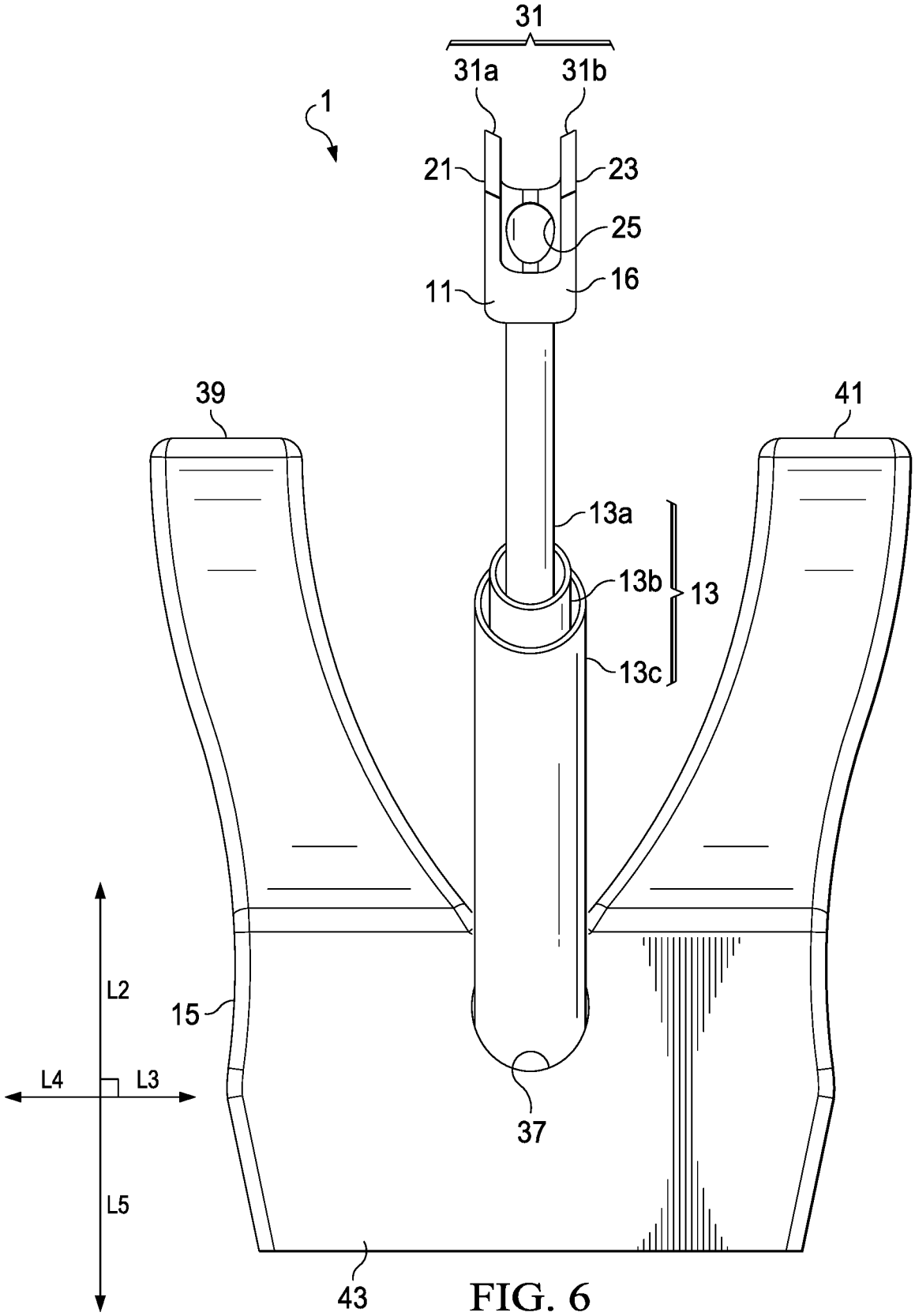
FIG. 6 is a top plan view of the batting tee.
Figure 7:
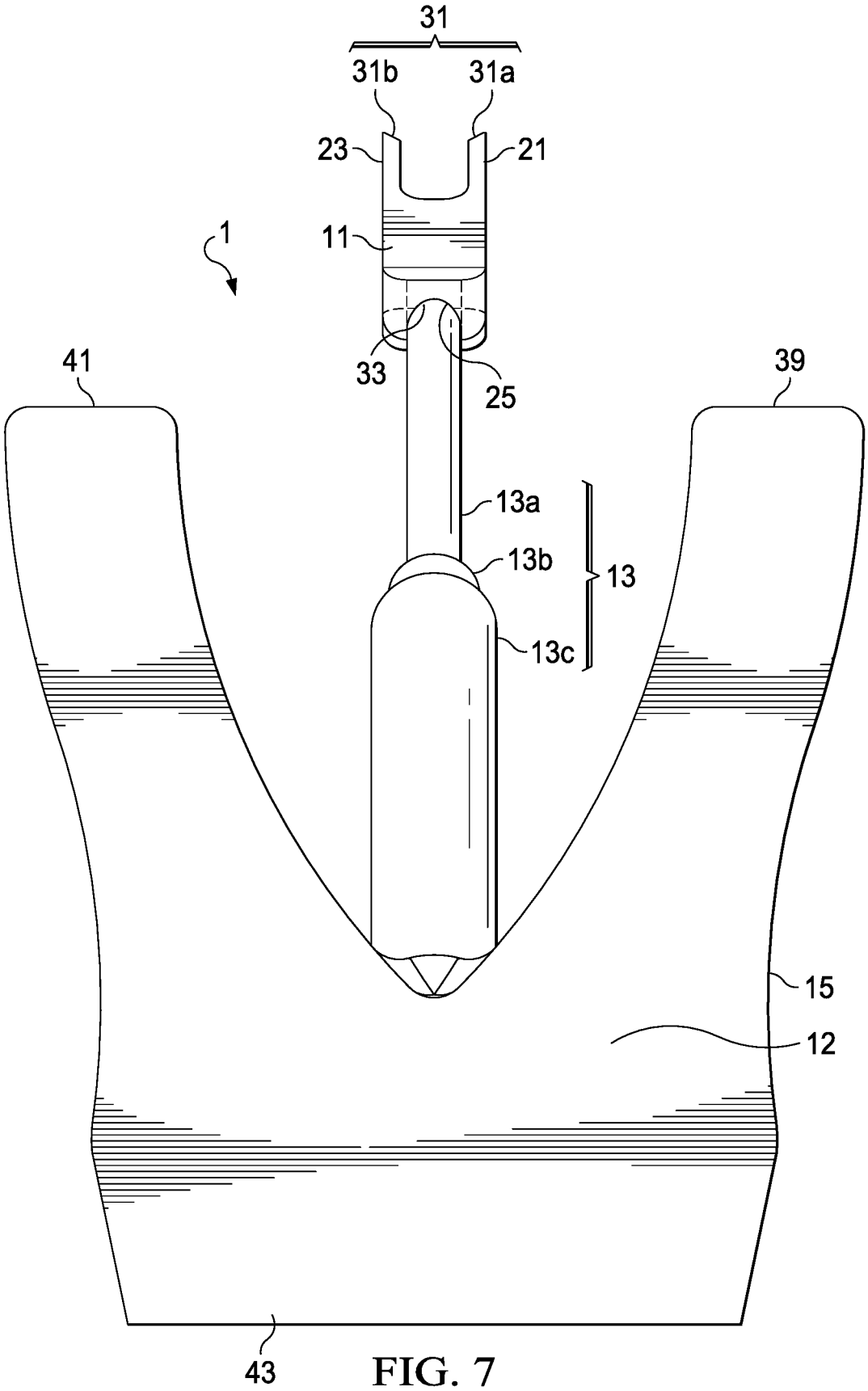
FIG. 7 is a bottom plan view of the batting tee.

FIG. 6 is a top plan view of the batting tee. FIG. 7 is a bottom plan view of the batting tee.

Figure 8:
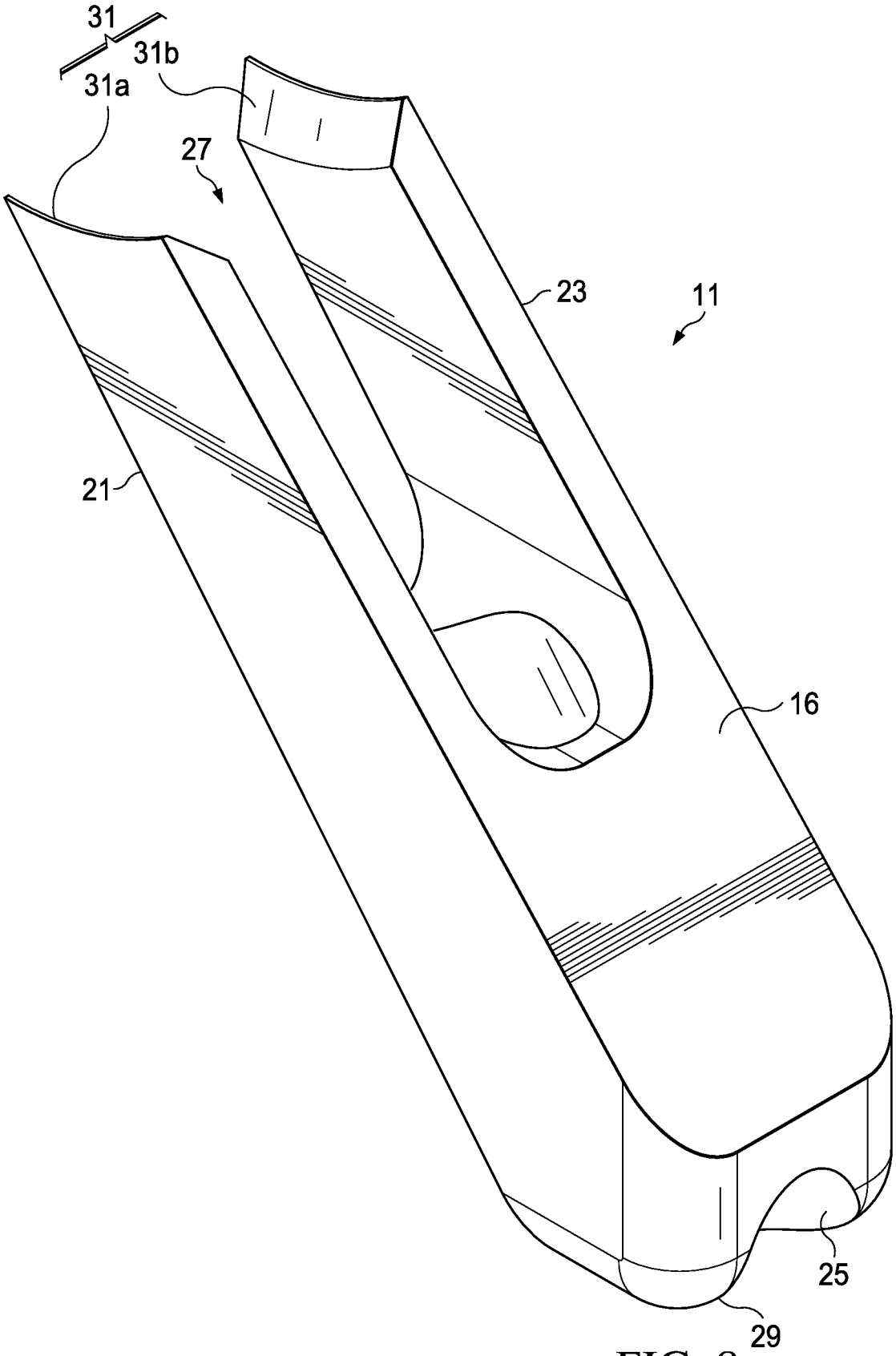
FIG. 8 is a perspective view of a ball holder of the batting tee.

The ball holder 11 of the first embodiment is shown in FIGS. 8-12. FIG. 8 is a perspective view of a ball holder of the batting tee. The ball holder 11 includes a first prong 21, a second prong 23, and a holder connector 25. The ball holder 11 can be a continuous unitary member made of a flexible material such as a rubber, a silicone, a polyurethane, a resin, or a plastic. The ball holder 11 can be manufactured by processes such as 3D-printing, injection molding, or casting.

Figure 9:
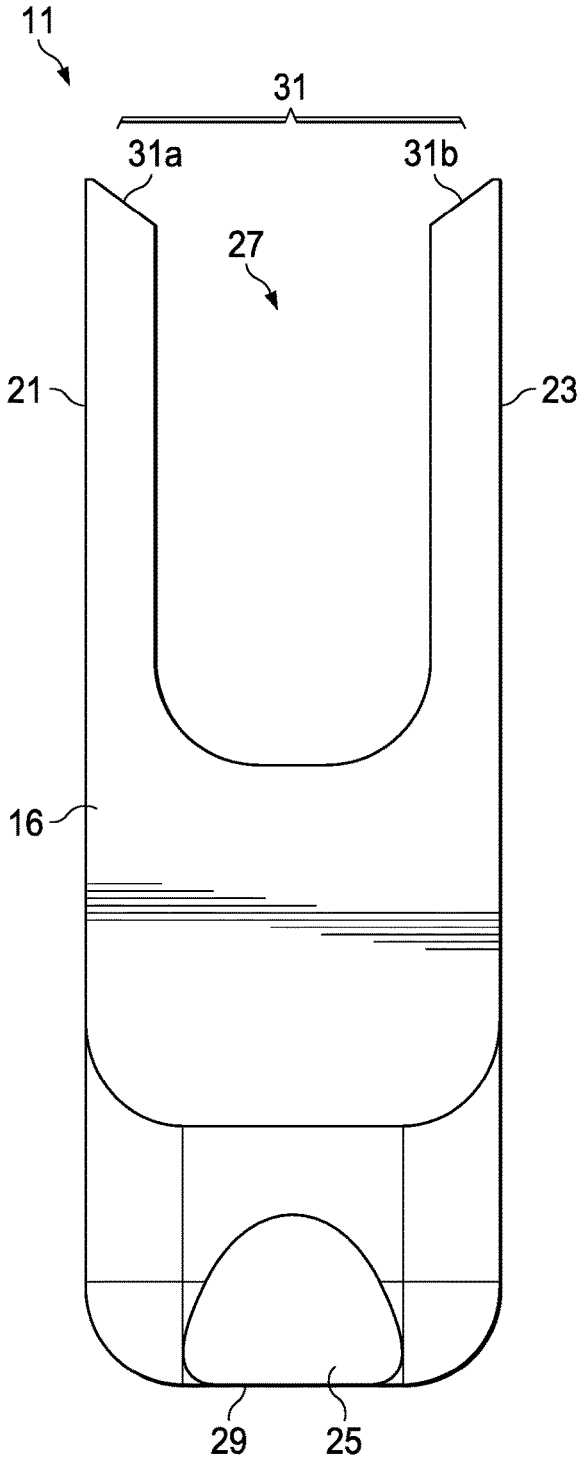
FIG. 9 is a rear elevation view of the ball holder.
Figure 10:
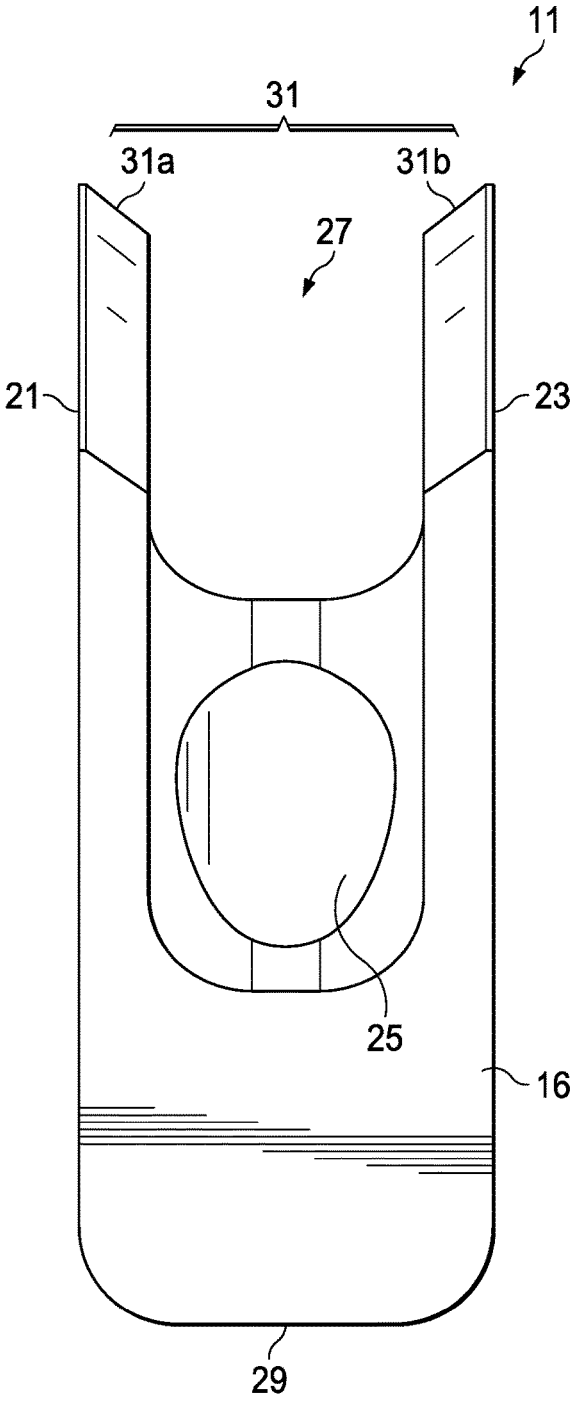
FIG. 10 is a top plan view of the ball holder.

FIG. 9 is a rear elevation view of the ball holder 11. FIG. 10 is a top plan view of the ball holder 11. As illustrated in FIGS. 9 and 10, the first prong 21 and the second prong 23 can extend in parallel directions relative to each other and are joined by holder connector 25. The first prong 21 and second prong 23 include recesses 31*a*, 31*b*. Recess 31*a* of the first prong 21 is separated from recess 31*b* of the second prong 23. The recesses 31*a*, 31*b* are concave and can be arc shaped. The recesses 31*a*, 31*b* can support the ball by either cradling an outer circumference of the ball, or can support the ball at contact points along each of the recesses 31*a*, 31*b*. The recesses 31*a*, 31*b* can be spherical cutouts. The spherical cutout measurement can be of a sphere having a diameter between 72 millimeters and 97 millimeters (2.8 inches and 3.8 inches). The spherical cutout measurement is preferably of a sphere having a diameter of 75 mm (3.0 inches). The recesses 31*a*, 31*b* are an example of a ball holding means that hold the ball.

Figure 11:
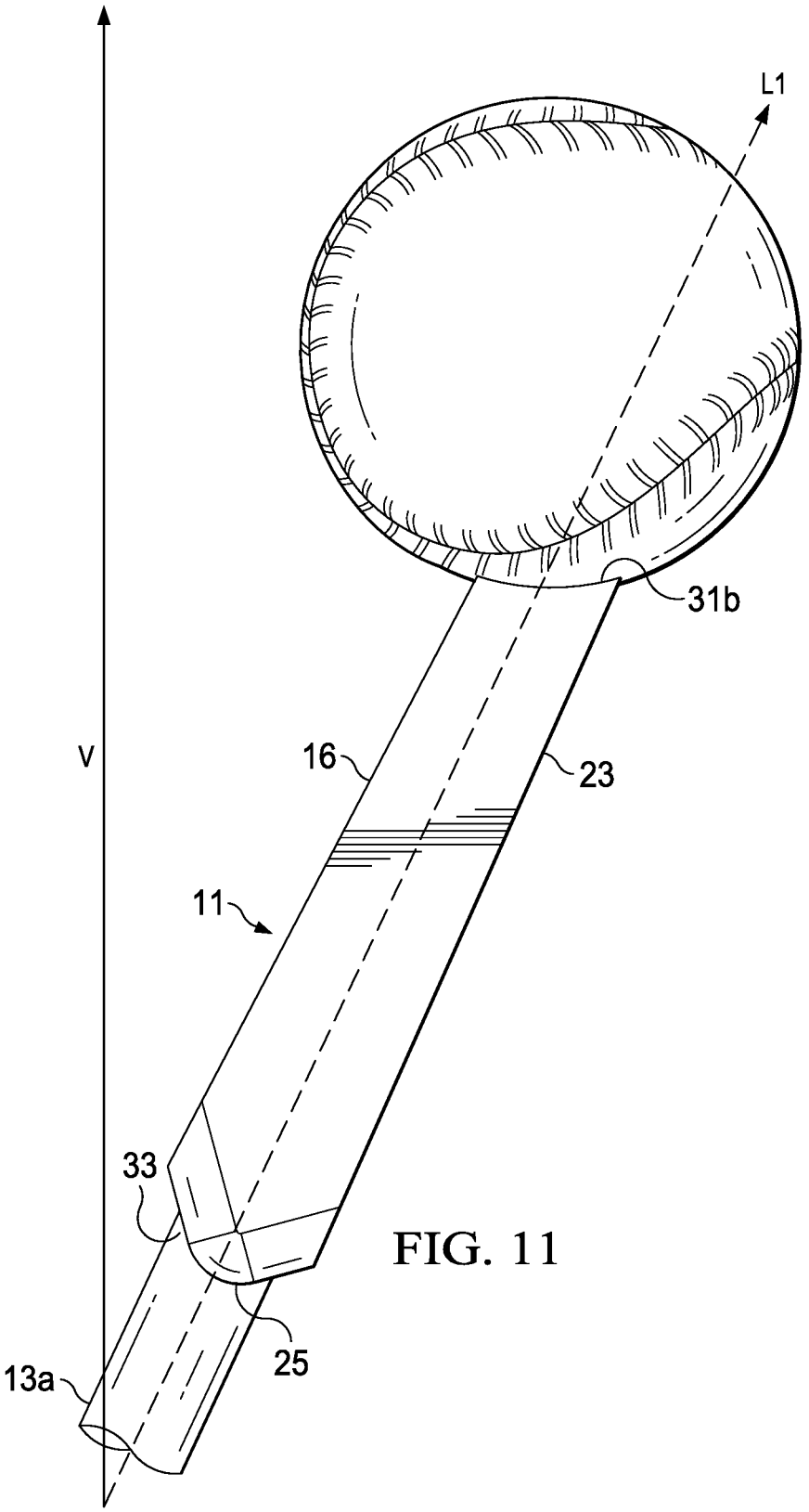
FIG. 11 is a right side elevation view of the ball holder holding a ball.
Figure 12:
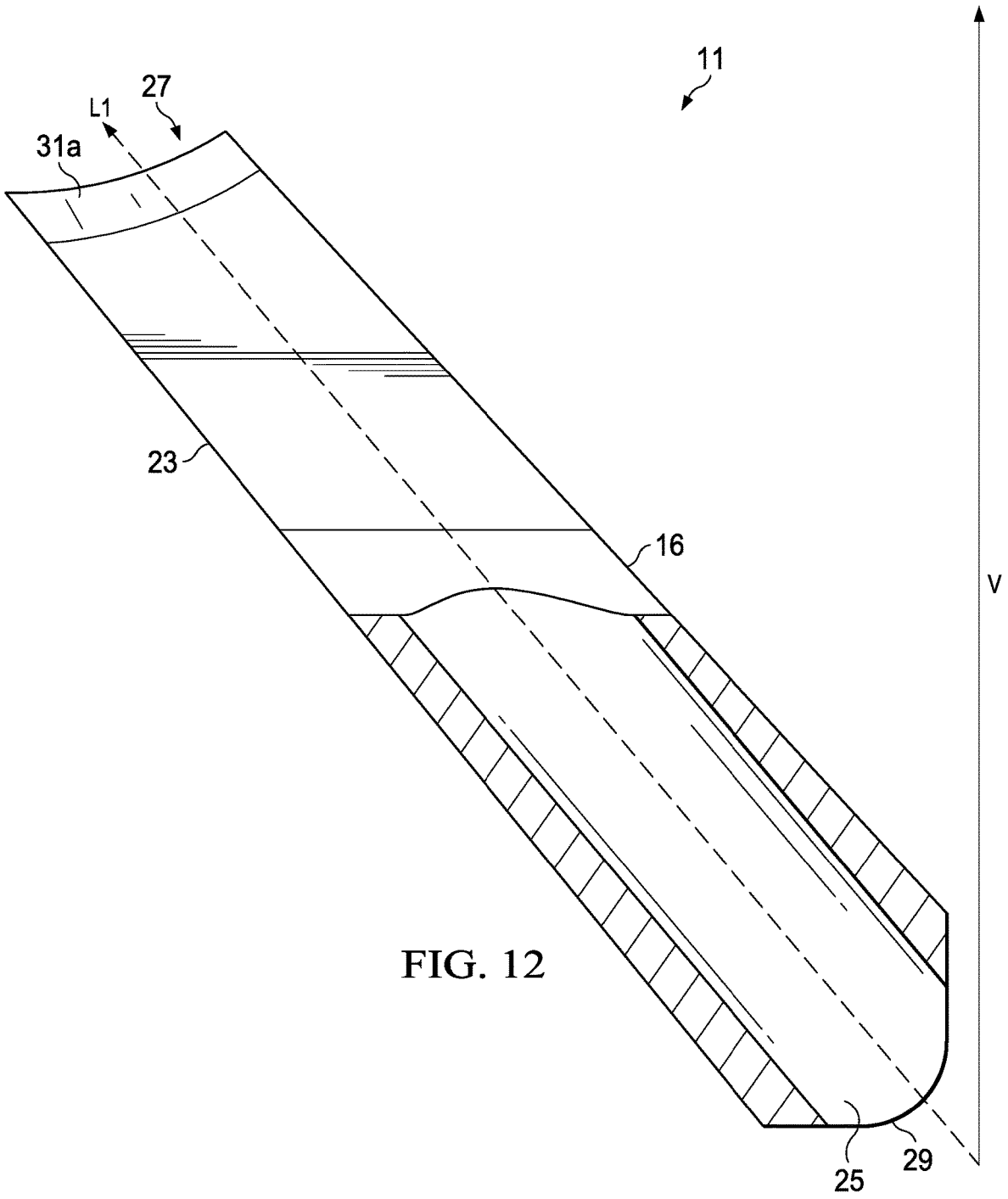
FIG. 12 is a cross section view of the ball holder.

FIG. 11 is a right side elevation view of the ball holder 11 holding a ball. FIG. 12 is a cross section view of the ball holder 11. As illustrated in FIGS. 11 and 12, the ball holder 11 extends in a longitudinal direction L1. The longitudinal direction L1 is inclined from a vertical direction V, preferably at an angle between 25 and 65 degrees. The first prong 21 and the second prong 23 extend in the longitudinal direction L1 of the ball holder 11. The first prong 21 and the second prong 23 terminate at a first distal end 27 of the ball holder 11. The holder connector 25 is at a second distal end 29 of the ball holder 11. The first distal end 27 is on an opposite end of the ball holder 11 from the second distal end 29.

The holder connector 25 connects the ball holder 11 to the shaft 13. For example, the holder connector 25 can be friction fit, threaded onto, fastened to, adhered to, or clipped to the shaft 13. The holder connector 25 is an example of a securing means for securing the ball holder 11 to the shaft 13. The holder connector 25 can be an annular recess, such as a bore, extending along the longitudinal direction L1 of the ball holder 11, and can be friction fit onto the shaft 13 as illustrated in FIG. 10. FIG. 10 illustrates the holder connector 25 extending through the ball holder 11, thereby creating a hole. However, the holder connector need not extend through the entirety of the ball holder 11.

The first prong 21 and the second prong 23 will often be hit by the batter. The first prong 21 and the second prong 23 are made of a flexible material, such as a rubber, a silicone, a polyurethane, a resin, or a plastic. The flexible material can prevent damage to a bat, prevents excessive negative feedback to the batter by deforming when the batter inadvertently hits the first and second prongs 21 and 23, and prevents premature failure of the ball holder 11. The first prong 21 and the second prong 23 can deform and return to their positions.

The shaft 13 of the first embodiment is illustrated in FIGS. 1-7. As illustrated in FIG. 5, the shaft 13 can position the ball holder 11 in the direction of a length of the shaft in-line with the longitudinal direction L1 of the ball holder 11. The length of the shaft 13 is adjustable in the longitudinal direction L1.

In the first embodiment, the shaft 13 includes an upper shaft 13*a*, a central shaft 13*b*, and a lower shaft 13*c*. The upper shaft 13*a* is adjustably extendable from the central shaft 13*b*. The central shaft 13*b* is adjustably extendable from the lower shaft 13*c* independent of the upper shaft 13*a*. The upper shaft 13*a*, the central shaft 13*b*, and the lower shaft 13*c* can be conventionally connected to telescope coaxially. The position of the ball can be adjusted by adjusting the length of the shaft 13.

The shaft 13 is mounted to the base 15. The shaft 13 can include a threaded portion that can be threaded into the base 15. The threaded portion can be disposed at the second end of the lower shaft 13*c* that is threaded into the base 15 as illustrated in FIGS. 1-7. The shaft 13 can be mounted by friction fit, clips, adhesive, or other appropriate mounts. The threaded portion is an example of a mounting means for mounting the shaft 13 to the base 15.

The shaft 13 can include a shaft connector 33 and a threaded portion (not illustrated). The shaft 13 can be made of a metal or any combination of appropriate materials (e.g. a rubber, a carbon fiber, a plastic, or a polyurethane). The shaft connector 33 is at a first end of the shaft 13. The threaded portion is at a second end of the shaft 13. The first end is on the opposite side of the shaft 13 from the second end.

The shaft connector 33 abuts the ball holder 11. The shaft connector 33 is disposed at the first end of the shaft 13. The shaft connector 33 can connect with the holder connector 25 of the ball holder 11. When the shaft connector 33 of the shaft 13 is connected to the holder connector 25 of the ball holder 11, the ball holder 11 is securely attached to the first end of the shaft 13, as illustrated in FIGS. 1-7 and 11. In the first embodiment, the shaft connector 33 is an end of a rod that is friction fit into the holder connector 25 of the ball holder 11.

Figure 13:
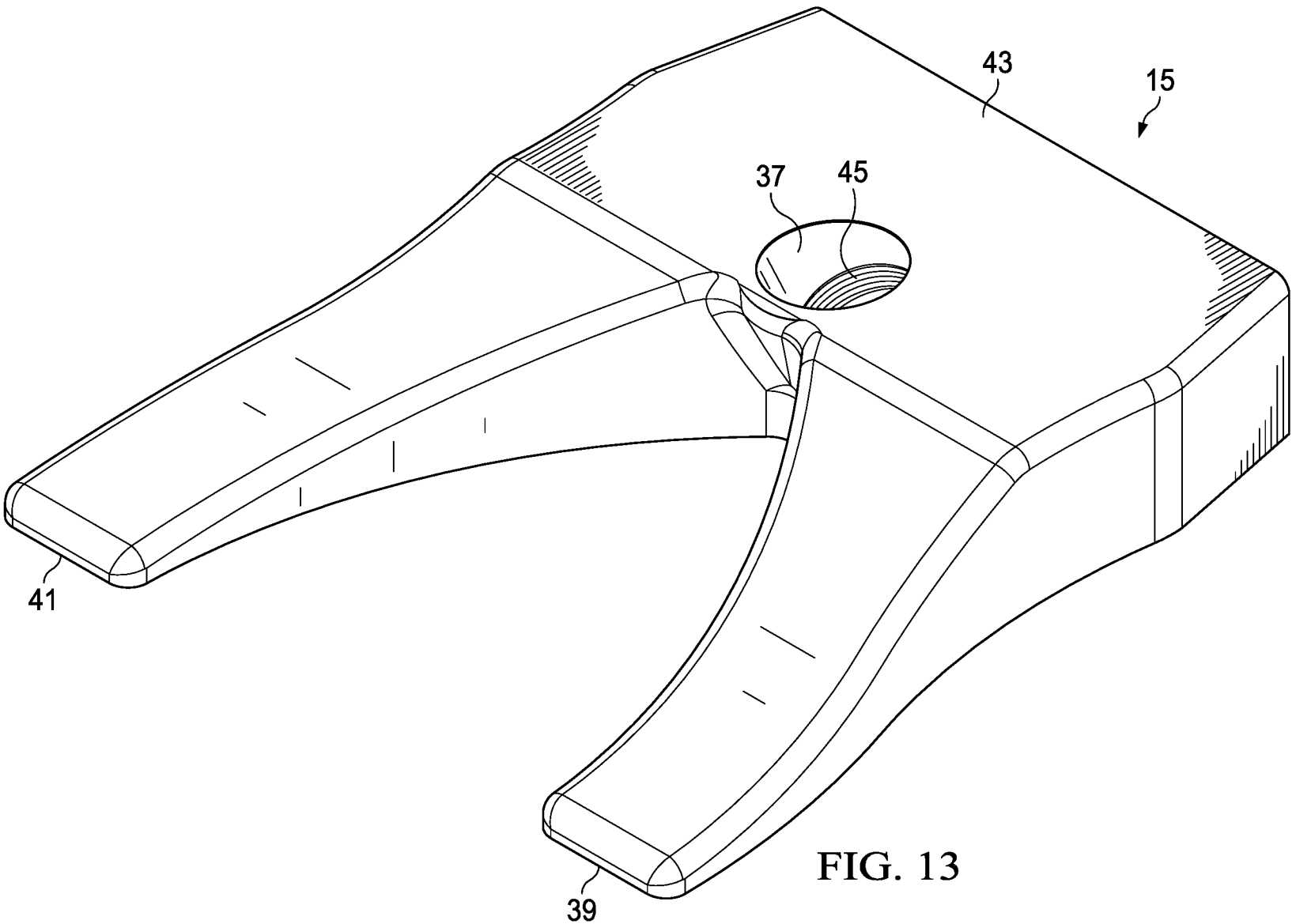
FIG. 13 is a perspective view of a base of the batting tee.
Figure 14:
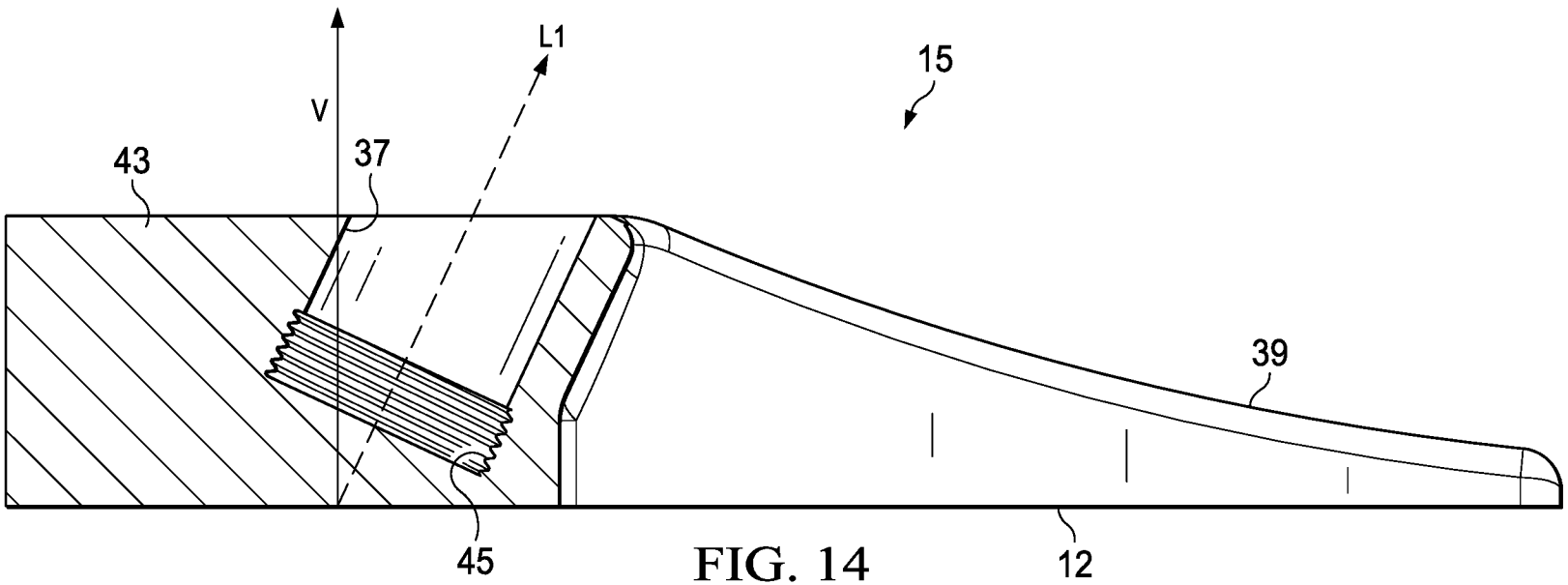
FIG. 14 is a cross section view of the base.

FIGS. 13 and 14 illustrate the base 15 of the first embodiment. FIG. 13 is a perspective view of a base of the batting tee. FIG. 14 is a cross section view of the base. A bottom surface 12 of the base 15 contacts the ground when the batting tee 1 rests on the ground. The base 15 supports the shaft 13 and the ball holder 11. The base 15 includes a mount 37, a first foot 39, a second foot 41, and a counter-balance 43. The first foot 39, the second foot 41, and the counter balance 43 of the base 15 stabilize the batting tee 1 in an upright position while the ball is being held by the ball holder 1. The base 15 can be a continuous unitary member made of plastic or combination of materials (e.g. resin, rubber, or metal).

The mount 37 accepts the threaded portion of the shaft 13. The mount 37 includes a threaded portion 45 into which the threaded portion of the shaft 13 can be threaded. When the threaded portion of the shaft 13 is threaded into the threaded portion 45 of the base 15, the ball holder 11 and the shaft 13 are stably supported by the base 15. As illustrated in FIG. 14, the mount 37 can be a bore into the base 15. The bore can axially extend inline with the longitudinal direction L1 of the ball holder 11. In the first embodiment, the mount 37 is bored at an incline of 25 degrees with respect to the vertical direction V.

As illustrated in FIG. 5, the first foot 39 extends from the mount 37 to be below the shaft 13 when the batting tee 1 is viewed in profile. The second foot 41 also extends from the mount 37 to be below the shaft 13 when the batting tee 1 is viewed in profile. Thus, the first foot 39 and the second foot 41 prevent the batting tee 1 from tipping in a longitudinal direction L2 of the base 15, as illustrated in FIG. 6. The longitudinal direction L2 is perpendicular to the vertical direction V and shares a plane with the horizontal direction H. As illustrated in FIG. 6, the first foot 39 and the second foot 41 are offset in a latitudinal direction L3 of the base 15 to prevent the batting tee 1 from tipping in the latitudinal directions L3 and L4. The latitudinal direction L3 is opposite to the latitudinal direction L4, and both latitudinal directions L3 and L4 are perpendicular to the longitudinal directions L1 and L2.

As illustrated in FIGS. 1, 2, 5 and 6, the counter-balance 43 protrudes from an opposite side of the mount 37 than the first foot 39 and the second foot 41.

In one implementation, the top portion of the base 15 (i.e., including the mount 37 and the base 15) is approximately 4 inches deep and approximately 7 inches across. In this implementation, the counter-balance is approximately 2.5 inches deep and approximately 7 inches across.

In this implementation, the first foot 39 and the second foot 41 are approximately 3 inches across and taper to 2 inches across. The top portions of the first foot 39 and the second foot 41 can be concave. Thus, the mass of the counter-balance 43 can be greater than the mass of the first foot 39 and the second foot 41 combined.

Accordingly, the counter-balance 43 counter-balances the ball holder 11 by providing leverage against the ground in an opposite direction from the first foot 39 and the second foot 41. As illustrated in FIG. 6, the counter-balance 43 stabilizes the batting tee from tipping in a longitudinal direction L5 of the base 15. The longitudinal direction L5 is opposite to longitudinal direction L2.

ADDITIONAL EMBODIMENTS

Figure 15:
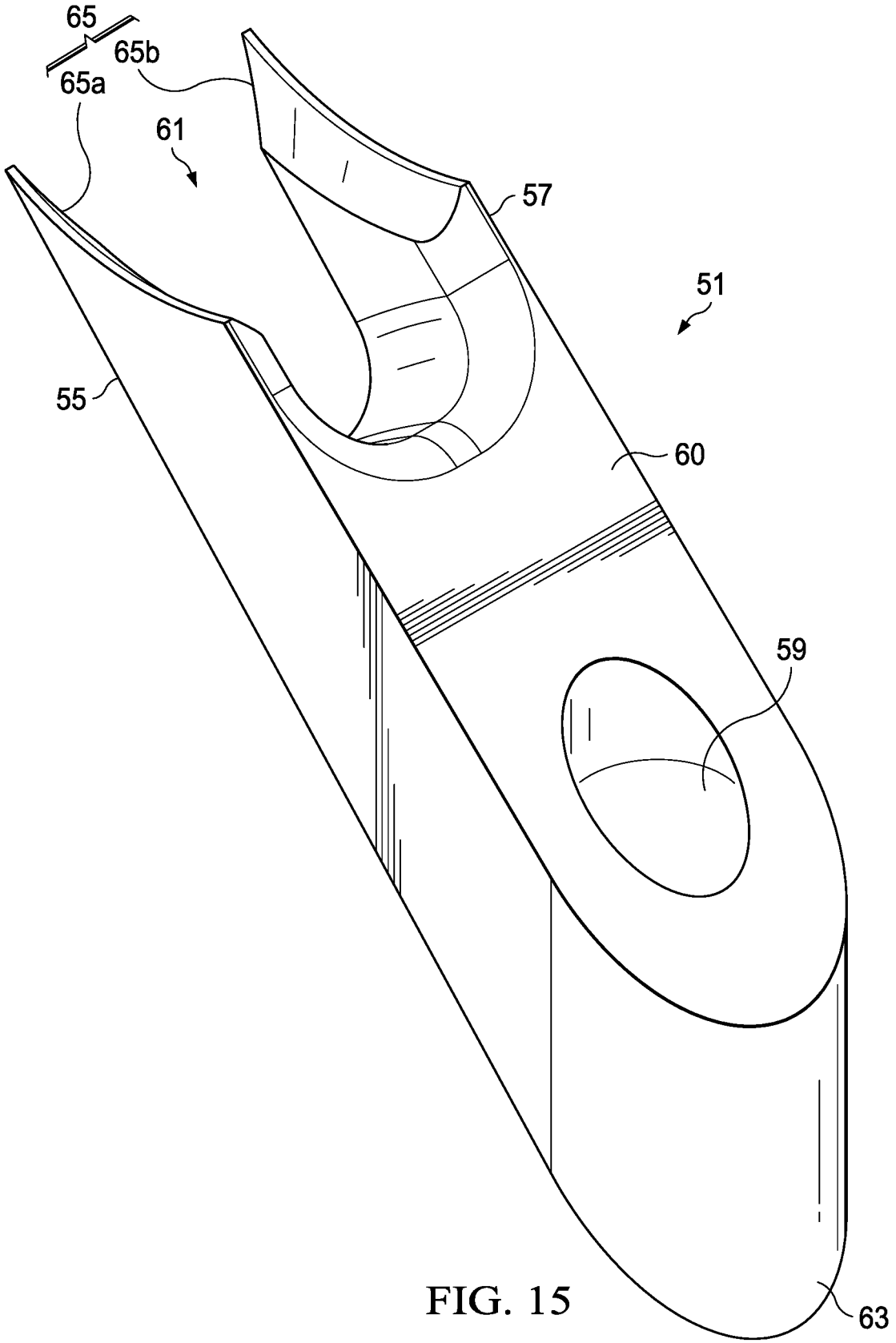
FIG. 15 is a perspective view of an alternative ball holder.

A second embodiment of a batting tee can improve conventional batting tees, and is illustrated in FIGS. 15-22. FIG. 15 is a perspective view of an alternative ball holder. The second embodiment can include a ball holder 51. The ball holder 51 can be supported by an uppermost distal end of the shaft of a conventional tee. The shaft of the conventional batting tee is another example of a support member that can support a ball holder.

The ball holder 51 of the second embodiment is shown in FIG. 15. The ball holder 51 includes a first prong 55, a second prong 57, and a holder connector 59. The ball holder 51 can be a unitary member made of a rubber-like material such as rubber, silicone, polyurethane, or plastic. The ball holder 51 can support a ball by the first and second prongs 55 and 57.

Figure 16:
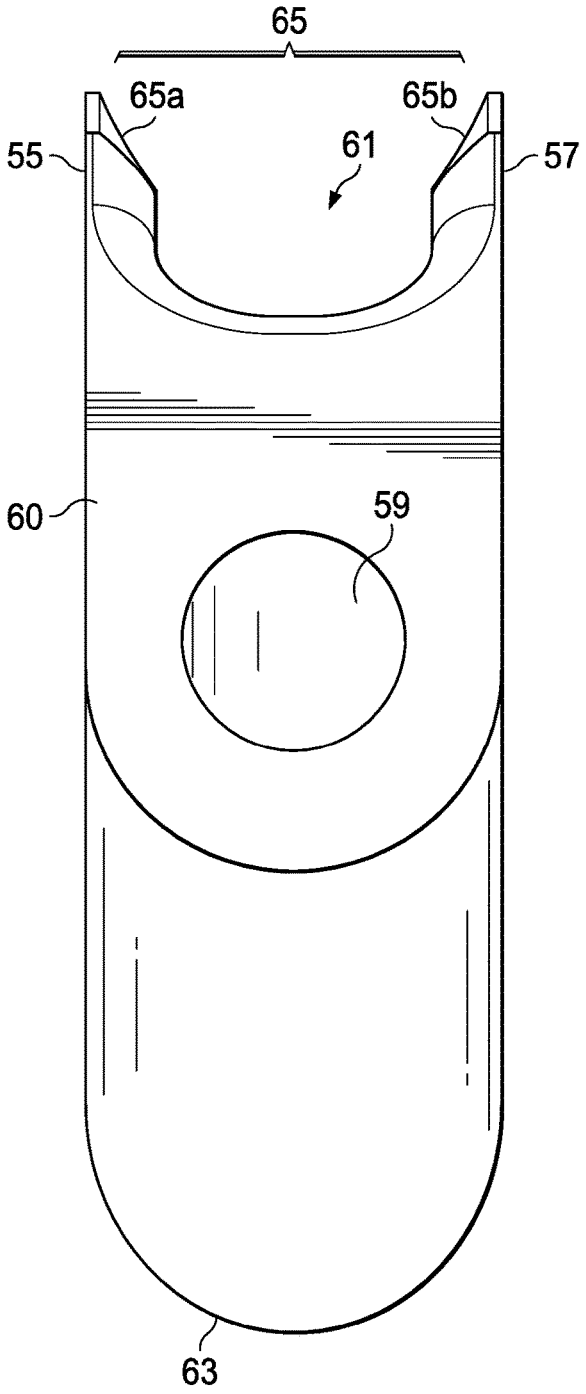
FIG. 16 is a rear elevation view of the alternative ball holder.
Figure 17:
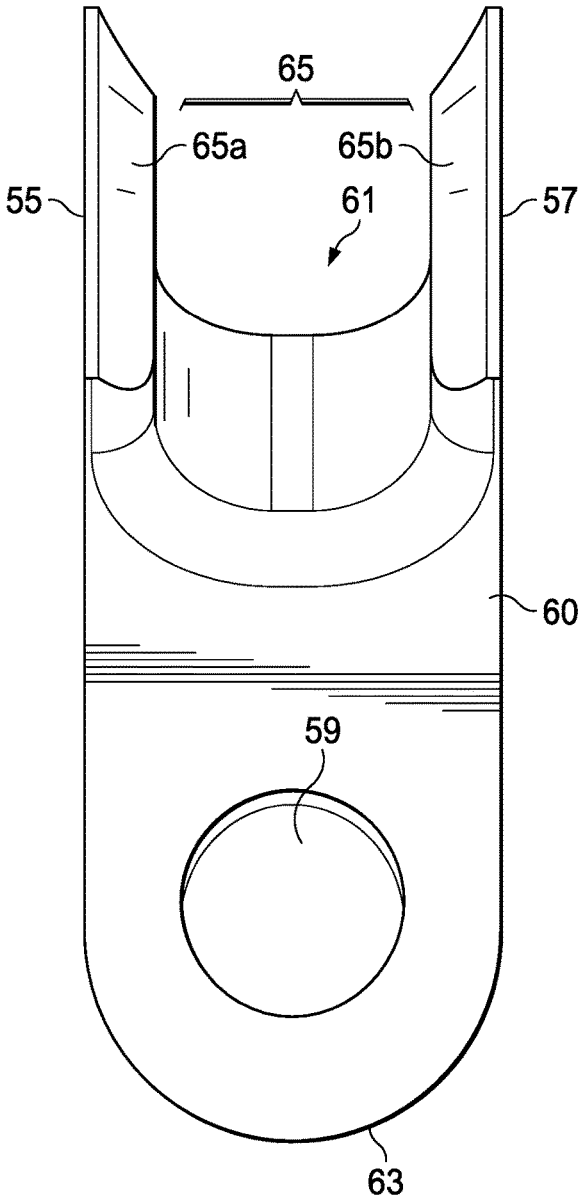
FIG. 17 is a top plan view of the alternative ball holder.

FIG. 16 is a rear elevation view of the alternative ball holder 51. FIG. 17 is a top plan view of the alternative ball holder 51. As illustrated in FIGS. 16 and 17, the first prong 55 and the second prong 57 can be arranged extending in parallel directions relative to each other. The first prong 55 and second prong 57 include recesses 65*a*, 65*b*. The recess 65*a* of the first prong 55 is separated by a gap from the recess 65*b* of the second prong 57 and are joined by the holder connector 59. The recesses 65*a*, 65*b* are concave and can be arc shaped. The recesses 65*a*, 65*b* can support the ball by either cradling an outer circumference of the ball, or can support the ball at contact points along each of the recesses 65*a*, 65*b*. The recesses 65*a*, 65*b* can be smooth or textured. The recesses 65*a*, 65*b* can be spherical cutouts. The spherical cutout measurement can be of a sphere having a diameter between 72 millimeters and 97 millimeters (2.8 inches and 3.8 inches). The spherical cutout measurement is preferably of a sphere having a diameter of 75 millimeters (3.0 inches). The recesses 65*a*, 65*b* are another example of a ball holding means for holding a ball.

The first prong 55 and the second prong 57 will often be hit by the batter. The first prong 55 and the second prong 57 can be made of a flexible, deformable material such as rubber, silicone, polyurethane, or plastic. The first prong 55 and the second prong 57 can deform and return to their original position. The deformable material prevents damage to a bat, reduces negative feedback to the batter from a miss swing, and ensures longevity of the ball holder 51.

Figure 19:
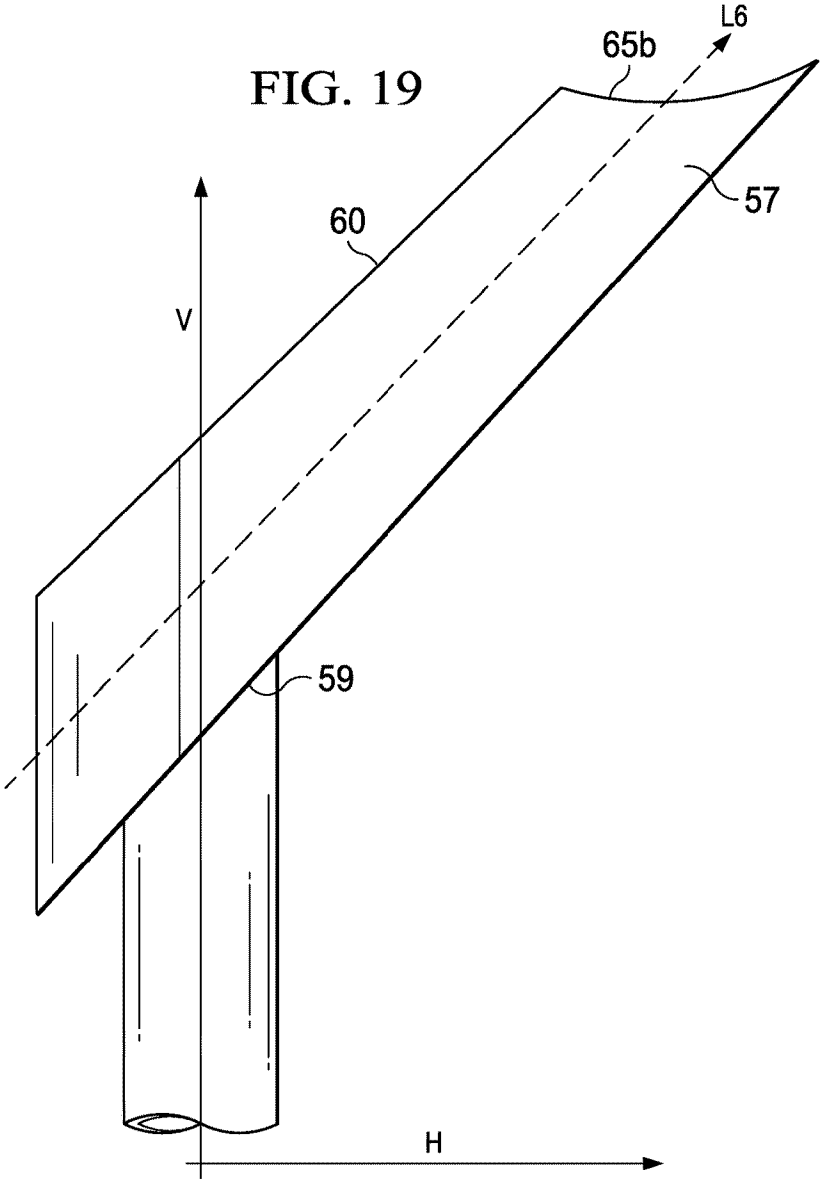
FIG. 19 is a right-side elevation view of the alternative ball holder mounted to a shaft.
Figure 18:
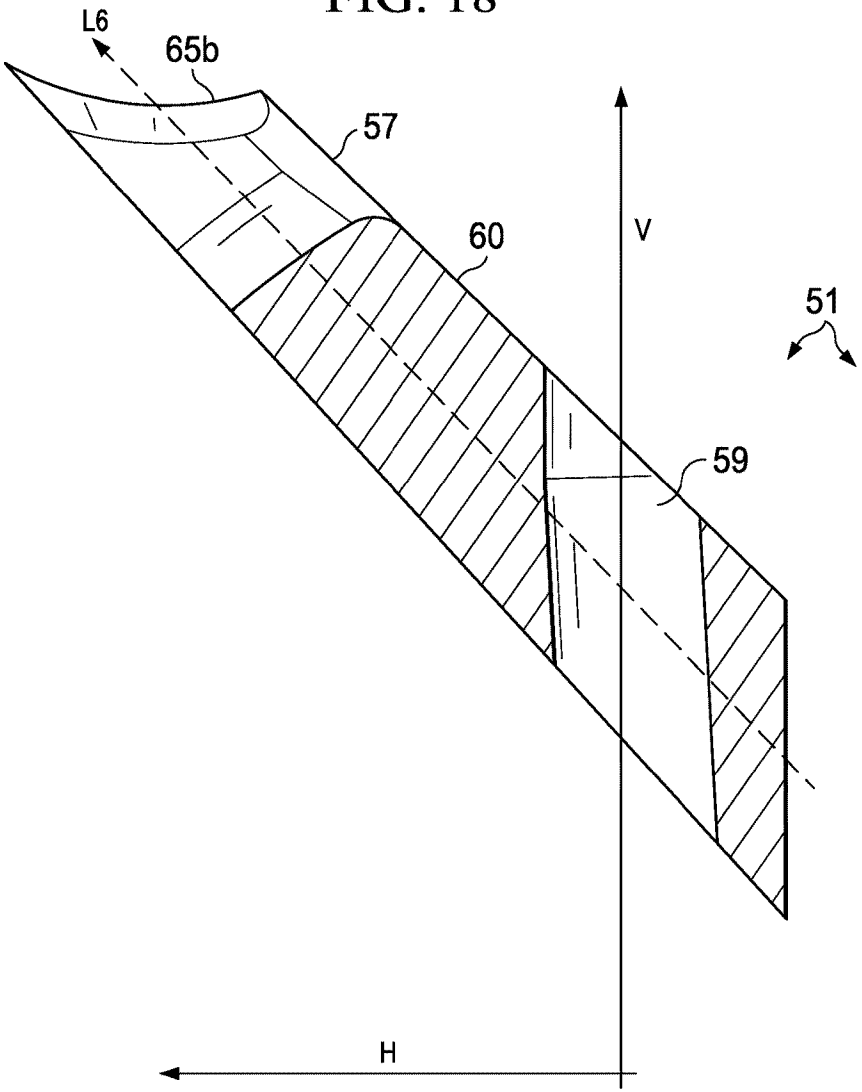
FIG. 18 is a cross section view of the alternative ball holder.

FIG. 18 is a cross section view of the alternative ball holder 51. FIG. 19 is a right-side elevation view of the alternative ball holder 51 mounted to a shaft. As illustrated in FIGS. 18 and 19, the ball holder 51 extends in a longitudinal direction L6. The longitudinal direction L6 is inclined with respect to the vertical direction V, preferably at an angle ranging from 25 and 65 degrees. The first prong 55 and the second prong 57 extend in the longitudinal direction L6 of the ball holder 51. The first prong 55 and the second prong 57 are at a first distal end 61 of the ball holder 51. The holder connector 59 is at a second distal end 63 of the ball holder 51. Although the holder connector 59 is described as being at a second distal end 63 of the ball holder 61, the ball holder 61 need not terminate in the holder connector 59. For example, the ball holder 61 can extend beyond the holder connector 59 in a distance equal or greater than the distance which the prongs extend.

Figure 20:
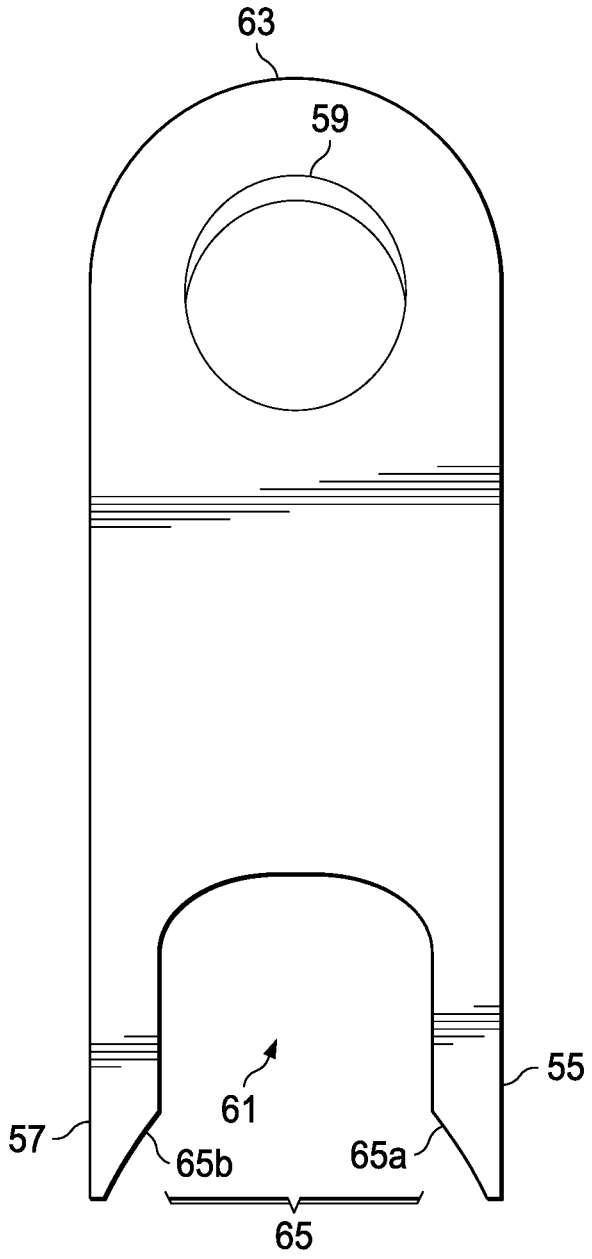
FIG. 20 is a bottom plan view of the alternative ball holder.
Figure 21:
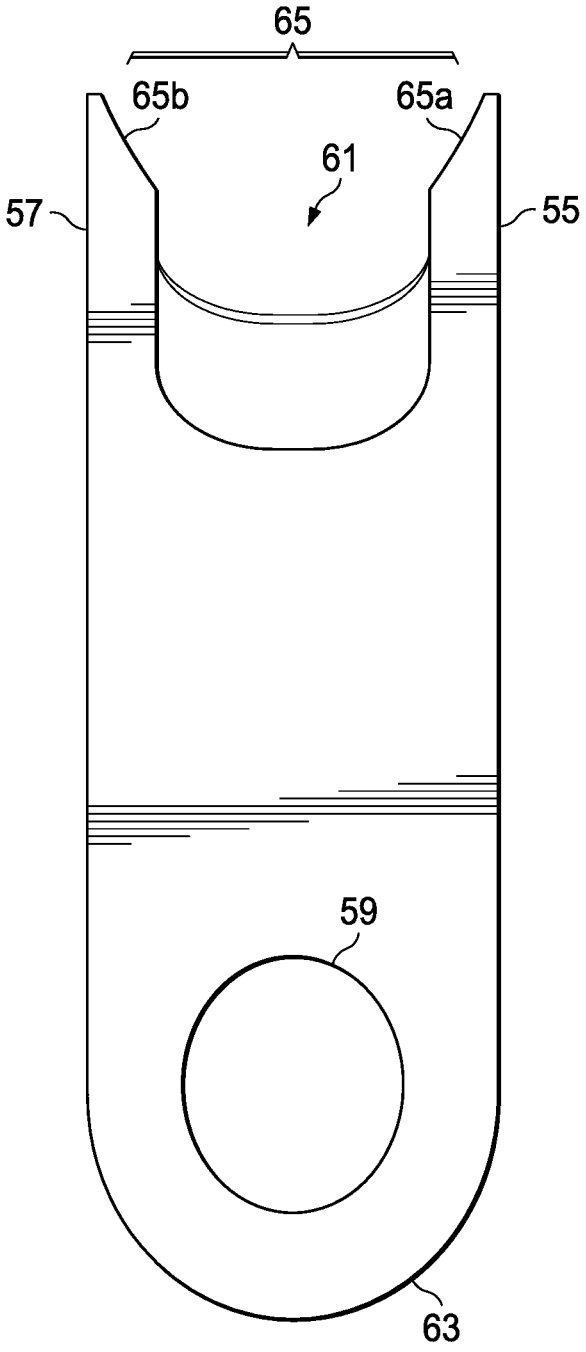
FIG. 21 is a front elevation view of the alternative ball holder.

FIG. 20 is a bottom plan view of the alternative ball holder 51. FIG. 21 is a front elevation view of the alternative ball holder 51.

Figure 22:
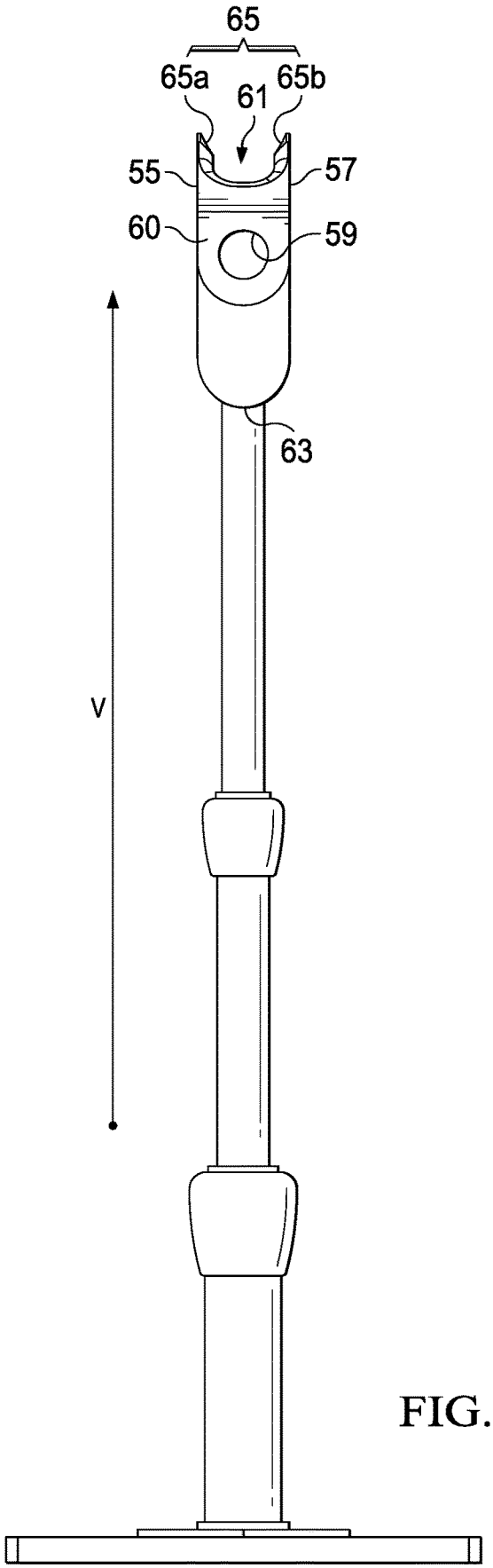
FIG. 22 is a front elevation view of the alternative ball holder mounted to a conventional batting tee.

FIG. 22 is a front elevation view of the alternative ball holder mounted to a conventional batting tee. In the second embodiment illustrated in FIG. 22, the ball holder 51 includes the holder connector 59. The holder connector 59 can connect the ball holder 51 to a conventional batting tee. The holder connector 59 is an example of a securing means for securing the ball holder 51 to the shaft of a batting tee. The holder connector 59 extends skew to the longitudinal direction L6 of the ball holder 51. The holder connector 59 can preferably extend in the vertical direction V. The holder connector 59 can fit onto the shaft of the conventional batting tee as illustrated in FIG. 22. The holder connector 59 can be friction fit, screwed, adhered, or otherwise removably fixed to the shaft of the conventional batting tee. To a left-handed batter, the arrangement of the ball holder 51 illustrated in FIG. 19 provides a visual guide surface 60 that is inclined from the horizontal direction H. The visual guide surface 60 can encourage a batter to swing upwards along the guide surface 60. Alternatively, an arrangement in which a right-handed batter faces the ball holder 51 which is rotated to face an opposite direction than as illustrated in FIG. 19, provides a visual confirmation of the exposure of lower surfaces of the ball. As a result, the batter can see that there are no barriers that will interfere with swinging at approach angles ideal for homeruns.

The uppermost distal end of the shaft of the conventional batting tee is illustrated in FIG. 22. The uppermost distal end of the shaft can support and position the ball holder 51. The shaft can be adjustable in the vertical direction V.

In the second embodiment, holder connector 59 of the ball holder 51 can be friction fit onto the shaft of the conventional batting tee.

MODIFICATIONS

The recesses 31 and recesses 65 of the first and second embodiments can be arc shaped. The recesses 31 and recesses 65 can have alternative shapes (e.g. polygonal, stylized, toothed). Further, the recesses 31 and recesses 65 need not be symmetrical.

The holder connector 25 and the holder connector 59 of the first and second embodiments are illustrated as tubular bores. The holder connector 25 and the holder connector 59 can have alternative shapes that fit onto a shaft, or alternative connection types such as clips, magnets, adhesives, and threaded sections.

The holder connectors 25 and 59 of the first and second embodiments are illustrated as tubular bores that traverse entirely through the ball holders 11 and 51. However, the holder connectors 25 and 59 can partially traverse through the ball holders 11 and 51. In this alternative, the closed end of the holder connectors 25 and 59 can stop the shaft, thus preventing improper installation of the ball holders 11 and 51.

The first embodiment describes the ball holder 11, shaft 13, and base 15 as separate unitary elements. However, any of the ball holder 11, shaft 13, and base 15 can be a multi-piece element. In addition, any contiguous combination of the ball holder 11, shaft 13, and base 15 can be a continuous unitary element.

The ball holder 51 is described as being connected to a base of a conventional batting tee in the second embodiment. Alternatively, the ball holder 51 can be connected to a base 15. In this alternative embodiment, the longitudinal direction of the shaft 13 can be parallel to the vertical direction V.

The shaft 13 is described as mounted to the base 15. Alternatively, the shaft 13 can be mounted to a base of a conventional batting tee.

The shaft 13 is described as including a threaded portion, and the mount 37 of the base 15 is described as including the threaded portion 45 in the first embodiment. Alternatively, the shaft 13 will not include the threaded portion, and the mount 37 will not include the threaded portion 45. In this alternative, the mount 37 includes a smooth bore, and the shaft can be friction fit into the smooth bore.

The mount 37 of the base 15 is described as including the threaded portion 45 in the first embodiment. Alternatively, the mount 37 might not include the threaded portion, and the threaded portion 45 can be friction or suction fit into the mount 37. In this alternative, the mount 37 includes a smooth bore, and the shaft can be friction fit into the smooth bore.

The base 15 is illustrated as having a smooth top surface. However, the base 15 can include one or more recesses. The recess may support the mount 37, or otherwise alter the rigidity of the base 15.

The base 15 is illustrated as having a flat bottom surface 12. The base 15 can alternatively have a hollow bottom. The hollow bottom can include one or more voids between points of the bottom. In this embodiment, the horizontal direction H is parallel to a plane made by points of the base 15 upon which it rests when the batting tee 1 is used by a batter.

The base 15 is illustrated as having smooth surfaces. However, the base can be textured, or can include ridges to provide structural stiffness.

The base 15 is illustrated as being a single monolithic structure. However, the base can be made of several parts, and can include weights to stabilize the batting tee 1.

Any combination of the ball holder 11, the ball holder 51, the shaft 13, and the base 15 can be manufactured by 3D-printing.

Any combination of the ball holder 11, the ball holder 51, the shaft 13, and the base 15 can be manufactured by injection molding.

Although this specification makes use of the phrase "one implementation," "first embodiment," "second embodiment," and the like, it is specifically contemplated that the features of any particular implementation or embodiment might be omitted. In addition, any particular implementation can include features of another implementation or embodiment. Thus, any implementation need not have all of the features of, for example, the same "one implementation."

What is claimed is:

1. A ball holder for a batting tee, consisting of:

a first prong disposed at a first distal end of the ball holder and including a first recess;

a second prong disposed at the first distal end of the ball holder and including a second recess, the first prong and the second prong extending in a planar fashion with each other; and a connector to connect the ball holder to the batting tee, wherein the connector is an annular reess or an elliptical recess and inclined at an angle between 25 and 65 degrees with respect to a bottom surface of the ball holder.

2. The ball holder of claim 1, wherein the first recess and the second recess are spherical cutouts of a sphere having a diameter between 72 millimeters and 97 millimeters.

3. The ball holder of claim 1, wherein the connector is disposed at a second distal end of the ball holder, the second distal end opposite to the first distal end.

4. The ball holder of claim 1, wherein the ball holder is flexible.

5. A kit for a batting tee, comprising:

a first prong disposed at a first distal end of the ball holder and including a first recess, a second prong disposed at the first distal end of the ball holder and including a second recess, the first prong and the second prong extending in a planar fashion with each other, and a connector to connect the ball holder to the batting tee, wherein the connector is an annular recess or an elliptical recess and inclined at an angle between 25 and 65 degrees with respect to a bottom surface of the ball holder;

a rigid, telescoping shaft including a first distal end to be attached to the holder connector; and a base including a top surface, the top surface including a mount to which a second distal end of the shaft is to be mounted, the mount maintaining the shaft at a fixed angle inclined from a vertical direction;

wherein the ball holder, the shaft, and the base are constructed and arranged to hold a ball such that portions of the batting tee nearest to the ball are hidden behind the ball.

6. The kit of claim 5, wherein the first recess and the second recess are spherical cutouts of a sphere having a diameter between 72 millimeters and 97 millimeters.

7. The kit of claim 5, wherein the connector is disposed at a second distal end of the ball holder, the second distal end opposite to the first distal end.

8. The kit of claim 5, wherein the ball holder is flexible.

* * * * *